United States Patent [19]

Ferrari et al.

[11] Patent Number: 4,903,967

[45] Date of Patent: Feb. 27, 1990

[54] RACKET FRAME HAVING HOLES FOR TAILORING FRAME STIFFNESS

[75] Inventors: Harry M. Ferrari; Michael R. Swartz, both of Pittsburgh, Pa.

[73] Assignee: Ferrari Importing Company, Inc., Pittsburgh, Pa.

[21] Appl. No.: 303,782

[22] Filed: Jan. 27, 1989

[51] Int. Cl.[4] ..... A63B 49/06

[52] U.S. Cl. ..... 273/73 C; 273/73 G

[58] Field of Search ..... 273/73 R, 73 C, 73 D, 273/73 F, 73 G, 73 H, 73 J, 73 K

[56] References Cited

U.S. PATENT DOCUMENTS

| | | | |
|---|---|---|---|
| Re. 31,419 | 10/1983 | Frolow | 273/73 G |
| D. 238,593 | 1/1976 | Sweet et al. | 273/73 C |
| 2,224,567 | 12/1940 | Reach | 273/73 C |
| 2,481,075 | 9/1949 | Brown | 273/73 |
| 3,528,658 | 9/1970 | Cheris et al. | 273/73 G |
| 3,633,910 | 1/1972 | Speule | 273/73 J |
| 3,647,211 | 3/1972 | Doessel et al. | 273/73 C |
| 3,734,519 | 5/1973 | Bennett | 273/73 F |
| 3,840,230 | 10/1974 | Schaefer et al. | 273/73 C |
| 3,966,207 | 6/1976 | Pass | 273/73 D |
| 4,192,505 | 3/1980 | Tabickman et al. | 273/73 C |
| 4,291,574 | 9/1981 | Frolow | 73/65 |
| 4,436,305 | 3/1984 | Fernandez | 273/73 C |
| 4,440,392 | 4/1984 | Popplewell | 273/73 C |
| 4,462,592 | 7/1984 | Legger et al. | 273/73 D |
| 4,655,455 | 4/1987 | Kurusu | 273/73 C |
| 4,664,380 | 5/1987 | Kuebler | 273/73 C |

FOREIGN PATENT DOCUMENTS

| | | | |
|---|---|---|---|
| 104930 | 4/1984 | European Pat. Off. | 273/73 R |

*Primary Examiner*—Edward M. Coven
*Assistant Examiner*—William Stoll
*Attorney, Agent, or Firm*—Michael R. Swartz; John R. Flanagan

[57] ABSTRACT

A racket frame, such as for a tennis racket, has a head portion, a handle portion and a throat portion extending between and interconnecting the head and handle portions. The head portion encompasses an open region and has a first plurality of stringing holes for attaching stringing to the head portion and across the open region. The throat portion is in the form of a pair of legs in a generally V-shaped configuration. The frame also includes a second plurality of non-stringing holes defined in one or both of the head and throat portions for forming voids in the material thereof to reduce the weight and tailor the stiffness thereof in a manner which reduces axial and torsional deflections of the head portion upon striking a ball by the stringing across the open region of the head portion.

20 Claims, 3 Drawing Sheets

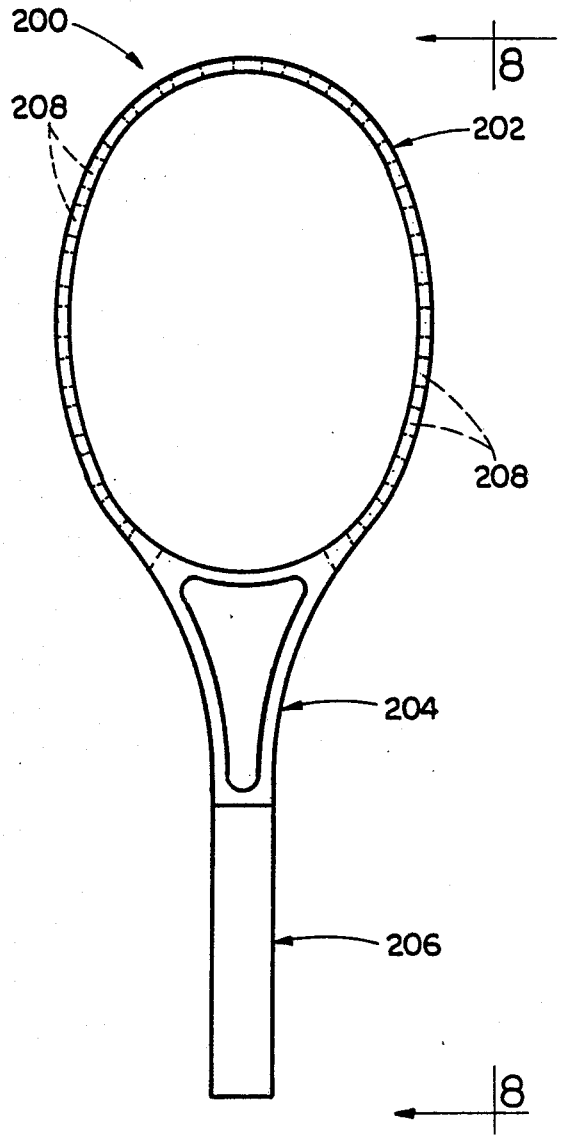
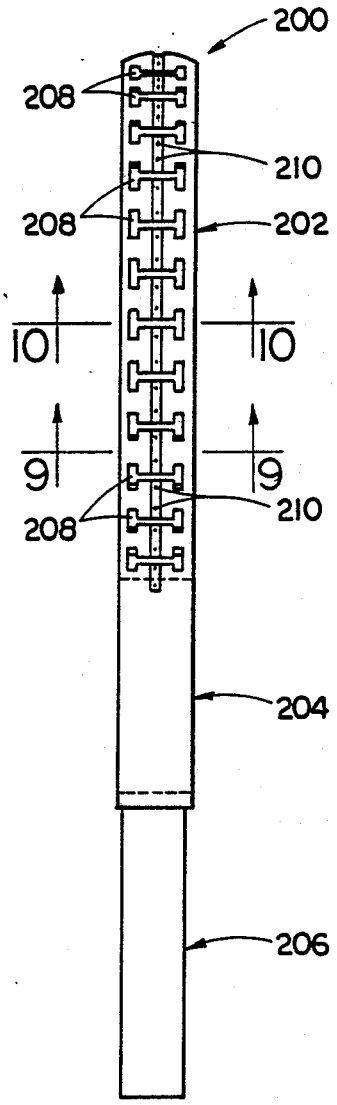
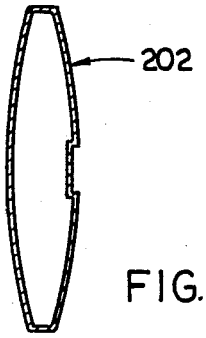
FIG. 9
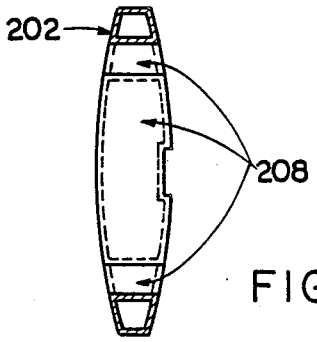
FIG. 10

RACKET FRAME HAVING HOLES FOR TAILORING FRAME STIFFNESS

CROSS REFERENCE TO RELATED APPLICATION

Reference is hereby made to the following copending application dealing with related subject matter and assigned to the assignee of the present invention: "Multi-Frame Racket" by H. M. Ferrari et al.

BACKGROUND OF THE INVENTION

1. Field of the Invention

The present invention generally relates to rackets for use in games and, more particularly, is concerned with racket frame constructions having holes for tailoring frame stiffness.

2. Description of the Prior Art

A conventional game racket frame, such as a tennis racket frame, is ordinarily an integral structure which includes a head portion, a throat portion and a handle portion. Typically, the racket frame is fabricated of composite-type material composed of high modulus fibers such as graphite fibers or glass fibers in a matrix of an epoxy resin. Also, racket frames have been fabricated from other materials, such as aluminum, wood and plastics.

The head portion of the racket frame typically has a round or oval configuration and contains a plurality of holes aligned in a common plane for applying stringing under tension and in a grid pattern across the head portion to provide a ball striking area of the racket. The handle portion of the racket frame is usually covered with an outer sheath for facilitating gripping of the racket by the user's hand.

The above-described construction of a conventional tennis racket poses several shortcomings to achievement of ball striking accuracy. In one common constructional feature, the height of the handle portion is greater than the height of the head portion measured in a direction normal to the plane of the stringing across the head portion. This common feature contributes to inaccuracy of ball striking directional aim as a result of deflecting of the racket head portion away from the longitudinal axis of the racket in response to the ball striking the head portion stringing. Also contributing to directional inaccuracy of the ball is the difference between the natural frequency of the conventional racket and the much greater resonance frequency of a tennis ball, typically greater by a factor ranging from 2.5 to 5. In addition to deviations in ball striking accuracy caused by deflection of the head portion, a ball striking the stringing off the longitudinal axis of the racket causes torsional or twisting motion about the longitudinal axis, thus shifting the line of travel of a struck ball from the desired direction.

The prior art contains tennis racket constructions which implicitly or explicitly attempt to overcome some or all of these struck ball directional inaccuracies. Representative of the prior art are U.S. Patents to Brown (U.S. Pat. No. 2,481,075), Spenle (U.S. Pat. No. 3,633,910), Tabickman et al (U.S. Pat. No. 4,192,505), Fernandez (U.S. Pat. No. 4,436,305), Popplewell (U.S. Pat. No. 4,440,392) and Kuebler (U.S. Pat. No. 4,664,380). The approach of the Kuebler patent is to provide the maximum height (measured in a direction normal to the stringing plane) of the racket frame in a triangular or bight region of the throat portion of the frame where it intersects with the head portion and to taper the height both toward the handle portion and the head portion of the racket frame in opposite directions along the longitudinal axis of the racket.

However, there are practical limitations on how much the frame height can be increased which may restrict the utility of the approach of the Kuebler patent in overcoming the above-described inaccuracies of a conventional racket frame. One limitation is that a significant increase in frame height in the head portion, adjacent the throat portion of the frame to stiffen the head portion against deflection, has the disadvantage of increasing the amount and location of material in the racket frame and thus frame weight and balance in a corresponding fashion.

Consequently, in view of the above-described drawbacks of the approach of the Kuebler patent to overcoming the struck ball directional inaccuracies of conventional tennis racket frame construction, a need still exists for another approach which will overcome these problems without creating new ones in their place.

SUMMARY OF THE INVENTION

The present invention provides a racket frame construction designed to satisfy the aforementioned needs. In contrast to the approach of the prior art which is to increase racket frame stiffness by increasing the frame height in the throat region of the frame, the approach of the present invention is to tailor racket frame stiffness preferably by increasing the frame height in both the throat and head regions of the racket frame and by introducing a second plurality of stiffness-tailoring holes, in addition to the first plurality of stringing holes, preferably in the head portion of the racket frame. The stiffness-tailoring holes can be of different sizes or shapes for removing different amounts of material and reducing different quantities of weight from the frame and thereby correspondingly varying the stiffness of the frame to overcome the shortcomings of the conventional racket frame while maintaining the positive aspects such as overall weight and balance of conventional frames. The height of the head and throat portions of the frame can either remain uniform or slight variation thereof can be utilized. By selecting the proper number, size and placement of the holes, it is believed that bending and twisting of the racket frame can be reduced to insignificant levels, and, theoretically, the torsional resonance frequency about the longitudinal axis and the in-line longitudinal axis excitation frequency can be made to approximately equal the natural frequency of a tennis ball.

Accordingly, the present invention is directed to a racket frame which comprises: (a) a head portion encompassing an open region and having a first plurality of stringing holes for attaching stringing to the head portion and across the open region; (b) a handle portion; (c) a throat portion extending between and interconnecting the head and handle portions; and (d) means defining a second plurality of non-stringing holes in at least the head portion being separate from the first plurality of stringing holes for forming, voids in the material of the head portion to reduce the weight and tailor the stiffness thereof in a manner which reduces axial and torsional deflections of the head portion upon striking a ball by the stringing across the open region of the head portion. In the preferred embodiment, the stiffness-tailoring holes in the second plurality are substantially larger in size than the stringing holes in the first plurality; however, the stiffness-tailoring holes can be smaller than the stringing holes.

More particularly, the head portion has a recess formed in an outwardly facing surface thereof with the stringing holes defined through the head portion opening outwardly at the recess and inwardly toward one another. The second plurality of non-stringing, stiffness-tailoring holes are formed through the head portion on opposite sides of the recess. The head portion can either be of hollow construction or solid construction. In the hollow construction type as illustrated, the stiffness-tailoring holes are defined by interior tubular wall sections of the head portion open at their opposite ends, however, alternatively, the stiffness-tailoring holes are defined in outer and inner sides of the head portion and open into the hollow interior thereof. In the solid construction type, the stiffness-tailoring holes are defined by thru-holes in the frame portion, and/or, can be defined by partial bores in the frame portion.

Alternatively, the stiffness-tailoring holes are defined through the head and throat portions. The throat portion is in the form of a pair of legs in a generally V-shaped configuration. A portion of the second plurality of stiffness-tailoring holes is formed through the throat portion legs. Also, in one embodiment, the frame and throat portions have a uniform height in the direction normal to the plane of the open region for the stringing encompassed by the head portion. Alternatively, the height of the frame portion tapers from the throat region to a maximum at approximately the middle of the head portion.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 7 is a plan view of a tennis racket frame in accordance with the present invention having a construction modified from that of FIGS. 1 and 4.

FIG. 8 is a side elevational view of the tennis racket frame as seen along line 8—8 of FIG. 7, showing the modified construction of the racket stiffness-tailoring holes in the head portion of the racket frame.

FIG. 9 is an enlarged fragmentary cross-section view of the tennis racket frame taken along line 9—9 of FIG. 8 and rotated ninety degrees clockwise.

FIG. 10 is another enlarged fragmentary cross-sectional view of the tennis racket frame taken along line 10—10 of FIG. 8 and rotated ninety degrees clockwise.

DETAILED DESCRIPTION OF THE INVENTION

Figure 1:
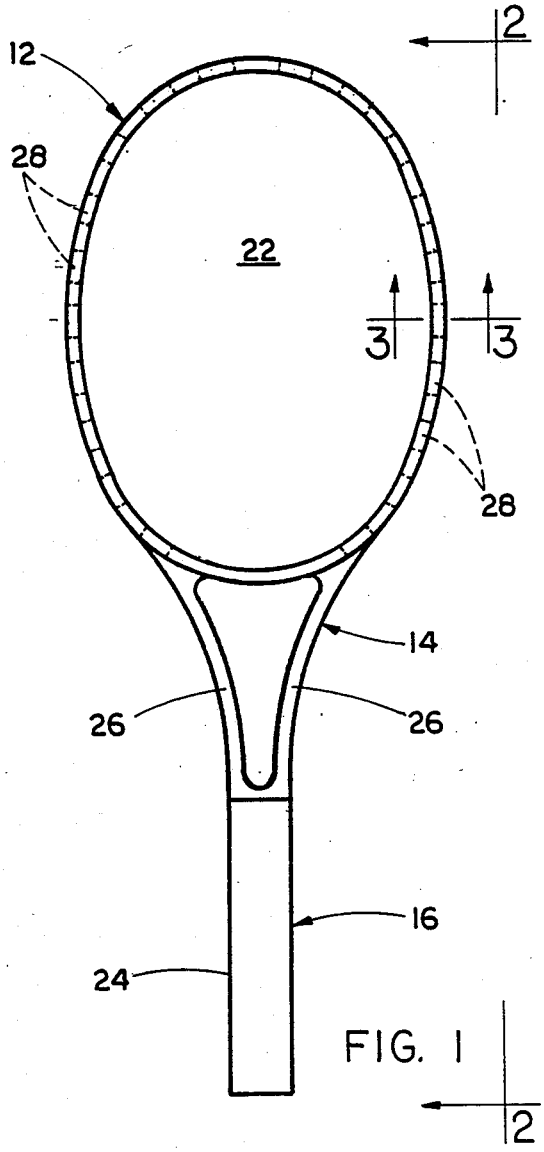
FIG. 1 is a plan view of a tennis racket frame in accordance with the present invention.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Figure 2:
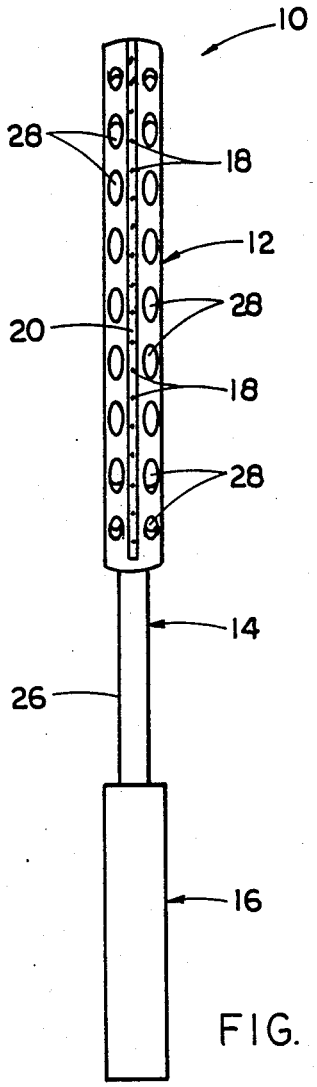
FIG. 2 is a side elevational view of the tennis racket frame as seen along line 2—2 of FIG. 1, showing the racket stiffness-tailoring holes in the head portion of the racket frame.
Figure 3A:
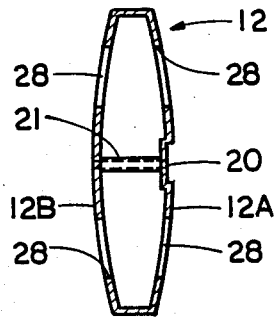
FIG. 3A is a view similar to that of FIG. 3 but showing an alternative construction of the racket stiffness-tailoring holes.
Figure 3:
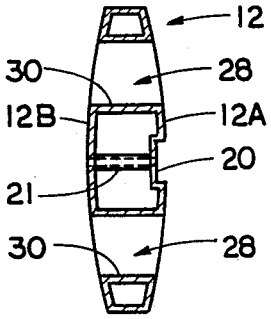
FIG. 3 is an enlarged fragmentary cross-sectional view of the tennis racket frame taken along line 3—3 of FIG. 1.

Referring now to the drawings, and particularly to FIGS. 1–3, there is shown a tennis racket frame, generally indicated by the numeral 10 and constructed in accordance with the principles of the present invention. While the constructional principles of the present invention are illustrated and described in conjunction with a tennis racket frame, they are believed to be equally applicable to the racket frames used in playing other sports comparable to tennis, such as squash, racquetball and badminton. Therefore, the reference hereafter to a tennis racket frame should be construed in a generic sense as applicable to other sport racket frames.

In its basic construction, the tennis racket frame 10 is a one-piece structure which includes a head portion 12, a throat portion 14 and a handle portion 16. The racket frame 10 is fabricated of composite-type material composed of high modulus fibers such as graphite fibers or glass fibers in a matrix of an epoxy resin. Alternatively, the racket frame 10 can be fabricated from other materials, such as aluminum, wood and plastics.

The head portion 12 of the racket frame 10 typically has a round or oval configuration and contains a first plurality of stringing holes 18 which open outwardly at a narrow recess 20 formed in an outwardly facing surface 12A of the head portion 12. The stringing holes 18 open inwardly toward one another and are aligned in a common plane. In a conventional manner, stringing (not shown) can be applied under tension through the holes 18 and across the open region 22 encompassed by the head portion 12 to form a grid pattern across the head portion, providing a ball striking area of the racket. The recess 20 is provided to protect the outer exposed portions of the stringing located at the stringing holes 18. Typically, the holes 18 have grommets 21 mounted in them through which the stringing is threaded.

The handle portion 16 of the racket frame 10 includes an outer sheath 24 for facilitating gripping of the racket by the user's hand. The throat portion 16 interconnecting the head and handle portions 12, 16 typically is in the form of a pair of shafts or legs 26 in a generally V-shaped configuration.

Racket Frame Stiffness-Tailoring Holes

In accordance with the principles of the present invention as seen in FIGS. 1–3, the head portion 12 of the racket frame 10 is provided with a second plurality of holes 28 for tailoring the stiffness of the racket frame. The second holes 28 are not for receiving stringing and are separate from the first, or stringing, holes 18. The second holes 28 form voids in the material of the head portion 12 and thereby reduce its weight. In so doing, the second holes 28 also tailor the stiffness thereof in a manner which reduces axial and torsional deflections of the head portion 12, as compared to the conventional racket frame head portion, upon striking a ball by the grid of stringing (not shown) extending across the open region 22 of the head portion 12.

More particularly, as readily apparent in FIG. 3, the second, or stiffness-tailoring, holes 28 are substantially larger in diametric size than first, or stringing, holes 18. For example, a typical stringing hole 18 can have a diameter of 0.100 inch, whereas the diameter of a typical stiffness-tailoring hole 28 can be 0.250 inch. Whereas the stringing holes 18 open outwardly through the recess 20 formed in the outwardly facing surface 12A of the head portion 12, the second, non-stringing, stiffness-tailoring holes 28 are formed through the head portion 12 on opposite sides of the recess 20, as clearly seen in FIGS. 2 and 3. Preferably, the stiffness-tailoring holes 28 are aligned in a pair of rows, one row on each side of the recess. The spacing between the holes 28 can range from 0.200 to 0.300 inch. No more than fifty percent of the surface area of the head portion 12 of the racket frame 10 should be occupied by the holes 28.

As seen in FIG. 3, the head portion 12 of the racket frame 10 has a hollow construction. In this embodiment, the stiffness-tailoring holes 28 are defined as passages through the head portion 12 by interior tubular sleeves or wall sections 30 of the head portion which extend through the interior thereof and open at their opposite ends at the outwardly and inwardly facing surfaces 12A, 12B of the head portion 12. In FIG. 3A is shown an alternative construction of the holes 28. In the latter construction, the holes 28 are defined in outer and inner sides or surfaces 12A, 12B of the head portion 12 and open into the hollow interior thereof. In both instances, preferably, the hollow interior of the head portion 12 is filled with filler foam material (not shown) whose purpose is to prevent chips, which are produced in the head portion during fabrication, from later making noise during use of the tennis racket.

It will also be noted in FIG. 2 that the head portion 12 of the racket frame 10 has a greater height than the throat portion 14. The height of the head portion 12, being the dimension in the direction normal to the plane of the open region 22 for the stringing encompassed by the head portion, is substantially uniform in this embodiment.

Figure 4:
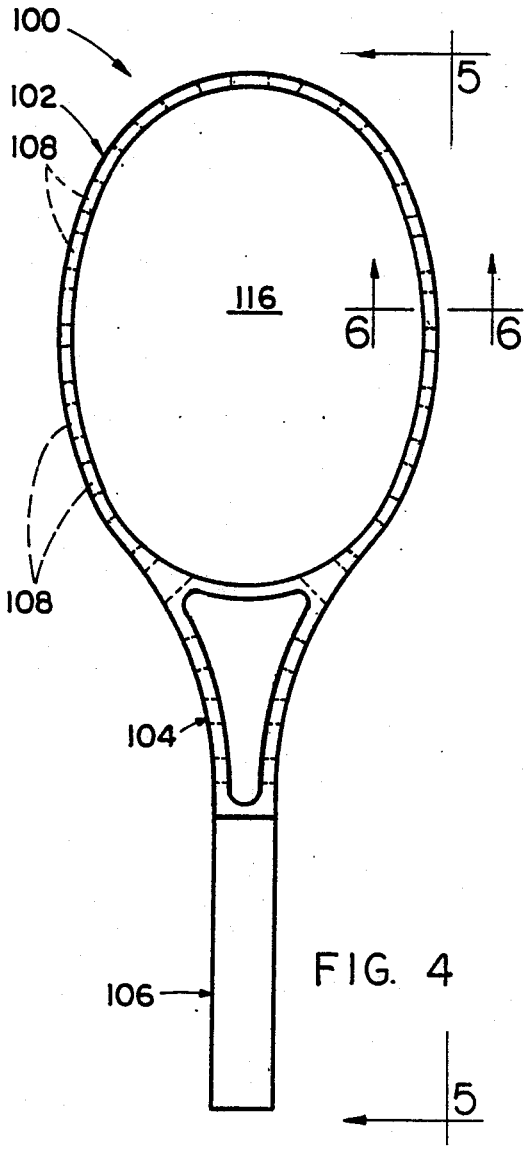
FIG. 4 is a plan view similar to that of FIG. 1 but showing a modified construction of a tennis racket frame.
Figure 5:
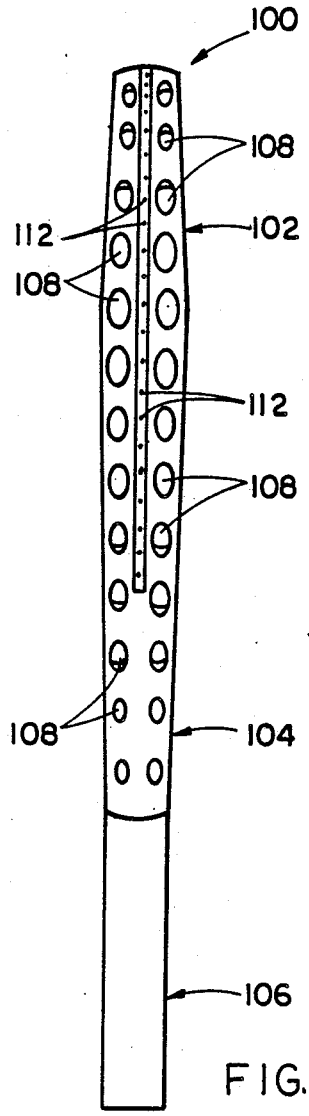
FIG. 5 is a side elevational view of the tennis racket frame as seen along line 5—5 of FIG. 5, showing the racket stiffness-tailoring holes in the head and throat portions of the racket frame.
Figure 6:
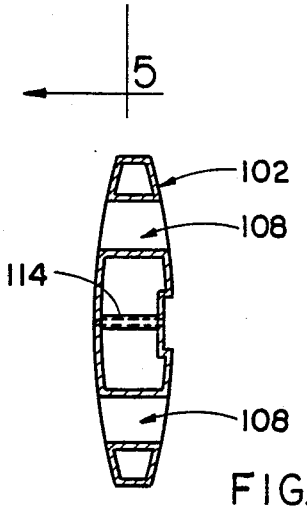
FIG. 6 is an enlarged fragmentary cross-sectional view of the tennis racket frame taken along 6—6 of FIG. 4.

Turning now to FIGS. 4–6, there is illustrated a modified construction of a tennis racket frame 100 in accordance with the principles of the present invention. The illustrated racket frame 10A has comparable basic head, throat and handle portions 102–106 to those of the racket frame 10 described above. One difference in the case of the racket frame 100 is that the second, or stiffness-tailoring, holes 108 are defined through both the head and throat portions 102,104. The portion of the holes 108 in the throat portion 104 is formed in the legs 110 thereof. The sizes and shapes of the second holes 108 need not differ from before. The second holes 28 and 108 are generally circular in shape. The stringing holes 112 and grommets 114 are substantially identical to those in FIGS. 2 and 3.

Another difference between the embodiment of FIGS. 4–6 and that of FIGS. 1–3 relates to the thickness of the head portion 102 of the racket frame 100, as seen in FIG. 5. The height of the frame 100, being in the direction normal to the plane of the open region 116 for the stringing encompassed by the head portion 102, tapers from the throat region 104 to a maximum at approximately the middle of the head portion.

Finally, FIGS. 7–10 illustrate another construction of a tennis racket frame 200 in accordance with the principles of the present invention. The head, throat and handle portions 202–206 are generally similar to those of the embodiment of the racket frame 10 in FIGS. 1–3, except for the following differences. First, the second, or stiffness-tailoring, holes 208 have a generally dog-bone cross-sectional shape and spaced between the first, or stringing holes, 210. Each dog-bone shaped second hole 208 substitutes for two of the second holes 28 in FIGS. 2 and 3. Second, the head and throat portions 202, 204 have a common uniform height.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. A racket frame, comprising:

(a) a head portion encompassing an open region and having a first plurality of stringing holes for attaching stringing to said head portion and across said open region;

(b) a handle portion;

(c) a throat portion extending between and interconnecting said head and handle portions; and (d) means defining a second plurality of non-stringing holes in at least said head portion being separate from said first plurality of stringing holes for forming voids in the material of said head portion to reduce the weight and tailor the stiffness thereof in a manner which reduces axial and torsional deflections of said head portion upon striking a ball by the stringing across said open region of said head portion.

2. The racket frame as recited in claim 1, wherein said stiffness-tailoring holes in said second plurality are substantially larger in size than said stringing holes in said first plurality.

3. The racket frame as recited in claim 1, wherein said head portion has a recess formed in an outwardly facing surface thereof with said stringing holes defined through said head portion opening outwardly at said recess and inwardly toward one another.

4. The racket frame as recited in claim 3, wherein said second plurality of non-stringing, stiffness-tailoring holes are formed through said head portion on opposite sides of said recess.

5. The racket frame as recited in claim 4, wherein said stiffness-tailoring holes are aligned in a pair of rows, one row on each side of said recess.

6. The racket frame as recited in claim 1, wherein said head portion is of hollow construction and said stiffness-tailoring holes are defined by interior tubular wall sections of said head portion open at their opposite ends.

7. The racket frame as recited in claim 1, wherein said head portion is of hollow construction and said stiffness-tailoring holes are defined in outer and inner sides of said head portion and open into the hollow interior thereof.

8. The racket frame as recited in claim 1, wherein said stiffness-tailoring holes are defined through said head and throat portions.

9. The racket frame as recited in claim 8, wherein said throat portion is in the form of a pair of legs in a generally V-shaped configuration and a portion of said second plurality of stiffness-tailoring holes are formed through said throat portion legs.

10. The racket frame as recited in claim 1, wherein said stiffness-tailoring holes are generally circular in shape.

11. The racket frame as recited in claim 1, wherein said stiffness-tailoring holes of said second plurality are generally of dog-bone cross-sectional shape and spaced between said stringing holes of said first plurality.

12. The racket frame as recited in claim 1, wherein said frame portion has a uniform height in the direction normal to the plane of said open region for the stringing encompassed by said head portion.

13. The racket frame as recited in claim 1, wherein the height of said frame portion, being in the direction normal to the plane of said open region for the stringing encompassed by said head portion, tapers from the throat region to a maximum at approximately the middle of the head portion.

14. A racket frame, comprising:

(a) a head portion encompassing an open region and having a first plurality of stringing holes for attaching stringing to said head portion and across said open region;

(b) a handle portion;

(c) a throat portion extending between and interconnecting said head and handle portions; and (d) means defining a second plurality of non-stringing holes in at least said throat portion for forming voids in the material of said throat portion to reduce the weight and tailor the stiffness thereof in a manner which reduces axial and torsional deflections of said head portion upon striking a ball by the stringing across said open region of said head portion.

15. The racket frame as recited in claim 14, wherein said stiffness-tailoring holes in said second plurality are substantially larger in size than said stringing holes in said first plurality.

16. The racket frame as recited in claim 14, wherein said throat portion is in the form of a pair of legs in a generally V-shaped configuration and at least a portion of said second plurality of stiffness-tailoring holes are formed through said throat portion legs.

17. A racket frame, comprising:

(a) a head portion encompassing an open region and having a first plurality of stringing holes for attaching stringing to said head portion and across said open region;

(b) a handle portion;

(c) a throat portion extending between and interconnecting said head and handle portions, said throat portion being in the form of a pair of legs in a generally V-shaped configuration; and (d) means defining a second plurality of non-stringing holes in said head and throat portions for forming voids in the material thereof to reduce the weight and tailor the stiffness thereof in a manner which reduces axial and torsional deflections of said head portion upon striking a ball by the stringing across said open region of said head portion.

18. The racket frame as recited in claim 17, wherein said stiffness-tailoring holes in said second plurality are substantially larger in size than said stringing holes in said first plurality.

19. The racket frame as recited in claim 17, wherein said head portion is of hollow construction and said stiffness-tailoring holes are defined by interior tubular wall sections of said head portion open at their opposite ends.

20. The racket frame as recited in claim 17, wherein said head portion is of hollow construction and said stiffness-tailoring holes are defined in outer and inner sides of said head portion and open into the hollow interior thereof.

* * * * *